US008665159B2

(12) United States Patent
Kuo et al.

(10) Patent No.: US 8,665,159 B2
(45) Date of Patent: Mar. 4, 2014

(54) HANDHELD DEVICE AND DISPOSITION METHOD OF PLANAR ANTENNA

(75) Inventors: Yen-Liang Kuo, Taoyuan County (TW); Wan-Ming Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 324 days.

(21) Appl. No.: 12/768,736

(22) Filed: Apr. 28, 2010

(65) Prior Publication Data

US 2011/0084884 A1 Apr. 14, 2011

(30) Foreign Application Priority Data

Oct. 9, 2009 (TW) ..... 98134312 A

(51) Int. Cl.
*H01Q 1/24* (2006.01)

(52) U.S. Cl.
USPC ..... 343/702; 343/873

(58) Field of Classification Search
USPC ..... 343/702, 872, 873, 700 MS
See application file for complete search history.

(56) References Cited

U.S. PATENT DOCUMENTS

| | | | | |
|---|---|---|---|---|
| 7,339,535 | B2 * | 3/2008 | Liang et al. | 343/702 |
| 7,973,727 | B2 * | 7/2011 | An et al. | 343/702 |
| 7,982,676 | B2 * | 7/2011 | Chen et al. | 343/702 |
| 8,130,170 | B2 * | 3/2012 | Nakahata et al. | 343/906 |
| 2006/0089184 | A1 | 4/2006 | Kim et al. | |
| 2008/0316120 | A1 * | 12/2008 | Hirota et al. | 343/702 |
| 2009/0015485 | A1 * | 1/2009 | Floyd et al. | 343/700 MS |
| 2009/0101494 | A1 * | 4/2009 | Wu et al. | 204/192.15 |
| 2009/0115669 | A1 * | 5/2009 | Cheng | 343/702 |

FOREIGN PATENT DOCUMENTS

| | | |
|---|---|---|
| CN | 101138131 | 3/2008 |
| EP | 1294051 | 3/2003 |
| FR | 2837036 | 9/2003 |
| JP | 2004172764 | 6/2004 |
| WO | 2007129410 | 11/2007 |

OTHER PUBLICATIONS

Masatsune, Terauchi. "Speaker built-in antenna, mount structure for speaker built-in antenna, electronic apparatus, and mount method for speaker built-in antenna." Published Jan. 17, 2004. Japanese patent publication JP 2004-172764 A. Machine Translation provided Jun. 12, 2012.*

"Office Action of China Counterpart Application", issued on Dec. 5, 2012, p. 1-p. 6, in which the listed reference was cited.

"European Search Report of Europe Counterpart Application," Issued on Jul. 23, 2010, p. 1-p. 3, in Which the Listed References Were Cited.

"First Office Action of Europe Counterpart Applition," Issued on Jul. 28, 2010, p. 1-p. 4, in Which the Listed Reference Was Cited.

* cited by examiner

*Primary Examiner* — Hoang V Nguyen
(74) *Attorney, Agent, or Firm* — Jianq Chyun IP Office

(57) ABSTRACT

A handheld device and a disposition method of a planar antenna are provided. The handheld device includes an appearance, a system ground plane, and the planar antenna. The appearance includes a via. The system ground plane is disposed inside the appearance. The planar antenna is disposed on the appearance and extended to an inner surface of the appearance through the via so as to be coupled to the system ground plane. Thereby, the performance of the planar antenna is improved.

15 Claims, 6 Drawing Sheets

HANDHELD DEVICE AND DISPOSITION METHOD OF PLANAR ANTENNA

CROSS-REFERENCE TO RELATED APPLICATION

This application claims the priority benefit of Taiwan application serial no. 98134312, filed on Oct. 9, 2009. The entirety of the above-mentioned patent application is hereby incorporated by reference herein and made a part of specification.

BACKGROUND OF THE INVENTION

1. Field of the Invention

The subject application generally relates to a disposition technique of a planar antenna, and more particularly, to a disposition technique of a planar antenna in a handheld device.

2. Description of Related Art

In recent years, wireless communication has gradually become the major communication method adopted by the public, and diversified wireless communication devices, such as smart phones, multimedia players, personal digital assistants (PDAs), and satellite navigators, have been provided. In addition, the design of electronic devices with wireless transmission function is going towards light weight and small size so that electronic devices suitable for daily use can be provided. In particular, an antenna is one of the most indispensable elements in a wireless communication system and critical to the performance of the entire system.

For example, a planar antenna is usually adopted in a mobile phone in order to reduce its size. The planar antenna is disposed in a housing or a cover and accordingly it may be affected by other elements (for example, a speaker, a battery, or a connector) of the cell phone. In addition, the height/volume of the clearance to the planar antenna is another major factor. Namely, the higher the clearance of the planar antenna is, the better performance the planar antenna has.

However, since there is very limited space in a mobile phone, it is very difficult to increase the height of the clearance to the planar antenna in the mobile phone.

SUMMARY OF THE INVENTION

Accordingly, the present invention is directed to a handheld device, wherein the signal receiving quality of a planar antenna in the handheld device is improved.

The present invention is directed to a disposition method of a planar antenna, wherein the signal receiving quality of the planar antenna is improved.

The present invention provides a handheld device including an appearance, a system ground plane, and a planar antenna. The appearance includes a via. The system ground plane is disposed inside the appearance. The planar antenna is disposed on the appearance and extended to an inner surface of the appearance through the via so as to be coupled to the system ground plane.

According to an embodiment of the present invention, the handheld device further includes a conductive device coupled between the planar antenna and the system ground plane. According to another embodiment of the present invention, the conductive device is a spring or a pogo pin.

According to an embodiment of the present invention, the planar antenna is disposed on the appearance through a coating technique, wherein the coating technique may be a molded interconnect device (MID) technique or a laser direct structuring (LDS) technique. According to another embodiment of the present invention, the planar antenna is disposed on the appearance through an injection molding technique.

According to an embodiment of the present invention, the system ground plane includes a feed point coupled to the planar antenna. According to another embodiment of the present invention, the system ground plane further includes a ground point coupled to the planar antenna.

According to an embodiment of the present invention, the handheld device further includes a passivation layer, wherein the passivation layer is disposed on the appearance and covers the planar antenna. According to another embodiment of the present invention, the planar antenna is disposed on an external surface of the appearance. According to yet another embodiment of the present invention, the planar antenna is disposed on an intermediate layer of the appearance.

According to an embodiment of the present invention, the via is served as a speaker. According to another embodiment of the present invention, the planar antenna forms a pattern on the appearance. According to yet another embodiment of the present invention, the handheld device further includes a coating material coated on the appearance, wherein the coating material and the planar antenna form a pattern on the appearance. According to still another embodiment of the present invention, the handheld device further includes a first coating material and a second coating material coated on the appearance, wherein the first coating material, the second coating material, and the planar antenna form a pattern on the appearance, and the color of the first coating material is different from the color of the second coating material.

The subject application provides a handheld device including an appearance, a system ground plane, and a planar antenna. The appearance includes a conductive via. The system ground plane is disposed inside the appearance. The planar antenna is disposed on the appearance and coupled to the system ground plane through the conductive via.

The subject application provides a disposition method of a planar antenna. In the disposition method, a via is formed in an appearance, and the planar antenna is disposed on the appearance, wherein the planar antenna is extended to an inner surface of the appearance through the via so as to be electrically connected to a system ground plane.

The subject application provides a disposition method of a planar antenna. In the disposition method, the planar antenna is disposed on an appearance, wherein the planar antenna is electrically connected to a via of the appearance and coupled to a system ground plane inside the appearance through the via.

As described above, in the subject application, an appearance is served as the carrier of a planar antenna, and the planar antenna is coupled to a system ground plane inside the appearance through a via of the appearance. Thereby, the performance of the planar antenna is improved.

BRIEF DESCRIPTION OF THE DRAWINGS

The accompanying drawings are included to provide a further understanding of the subject application, and are incorporated in and constitute a part of this specification. The drawings illustrate embodiments of the invention and, together with the description, serve to explain the principles of the invention.

DESCRIPTION OF THE EMBODIMENTS

Figure 1:
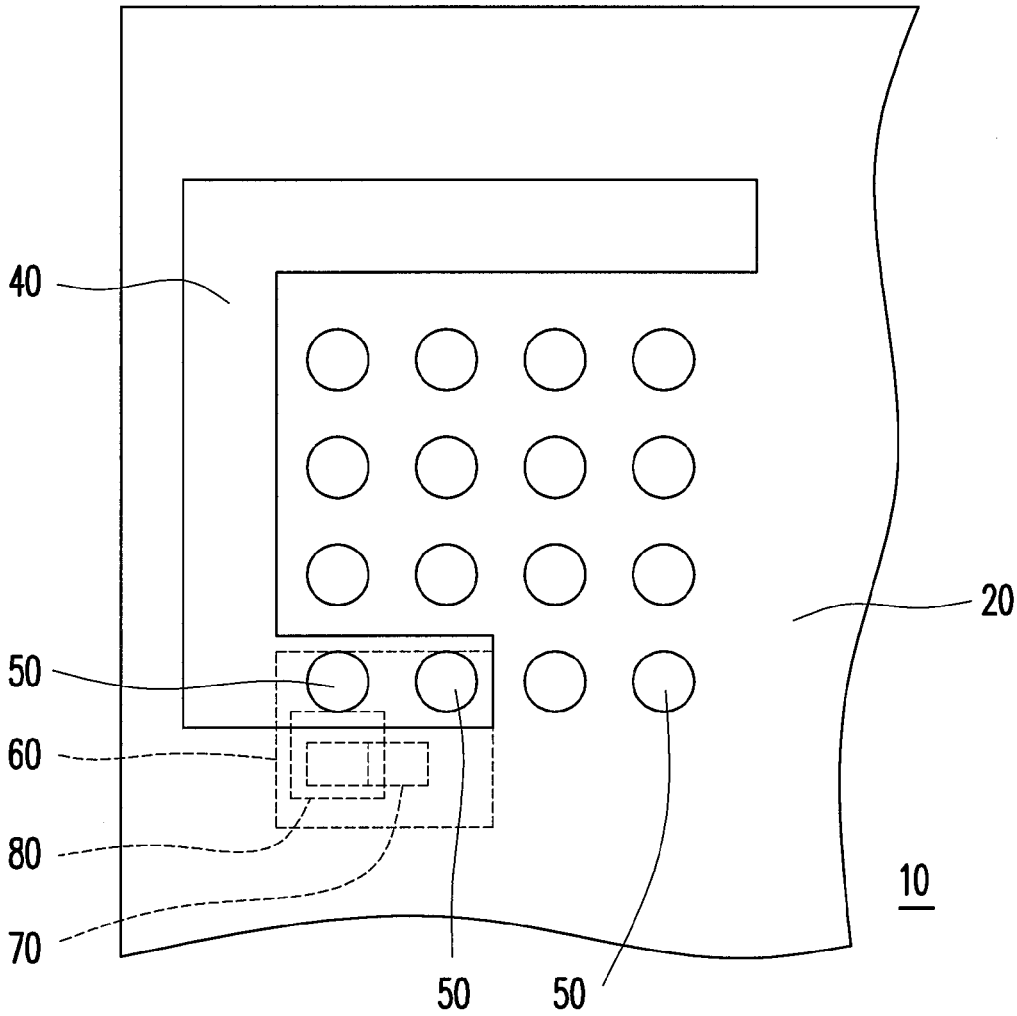
FIG. 1 is a top view of an appearance and a planar antenna according to a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Conventionally, a small volume and a good performance cannot be achieved at the same time in a cell phone.

In embodiments of the present invention, a planar antenna (a planer inverted-F antenna (PIFA)) is disposed on an appearance of a handheld device through a coating technique (for example, a molded interconnect device (MID) technique or a laser direct structuring (LDS) technique), wherein the appearance may be a sound hole cover of a speaker. After that, a conductive metal liquid is filled through a hole on the sound hole cover from an external surface of the appearance, so as to form a ground area and a feed area on an inner surface of the appearance. Thus, a radiating body of the planar antenna located on the external surface of the appearance is electrically connected to the ground area and the feed area on the inner surface of the appearance. Next, the planar antenna is electrically connected to a substrate (including a system ground plane, a RF circuit, and a matching circuit) by using a spring or a pogo pin. This planar antenna has a creative structure, and since the PIFA does not require a large clearance, other elements (for example, the speaker) can be disposed below the PIFA. Accordingly, both internal and external spaces taken by the planar antenna are reduced, and the requirements in the appearance, ID design, fabricating cost, and signal receiving effect of the mobile phone can all be met. Reference will now be made in detail to the present preferred embodiments of the invention, examples of which are illustrated in the accompanying drawings. Wherever possible, the same reference numbers are used in the drawings and the description to refer to the same or like parts.

Figure 2:
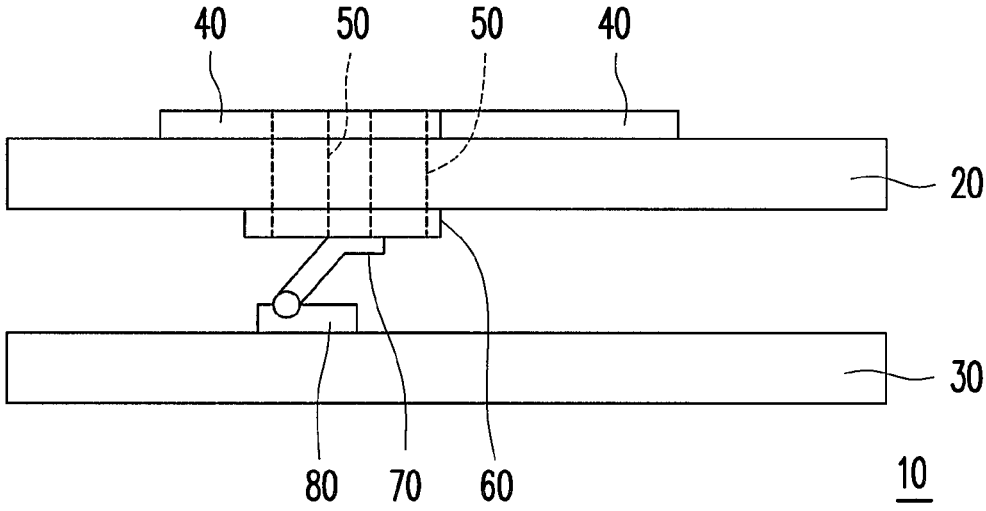
FIG. 2 is a side view of the appearance and the planar antenna in FIG. 1.

FIG. 1 is a top view of an appearance and a planar antenna according to a first embodiment of the present invention, and FIG. 2 is a side view of the appearance and the planar antenna in FIG. 1. Referring to both FIG. 1 and FIG. 2, the handheld device 10 includes an appearance 20, a system ground plane 30, and a planar antenna 40. In the present embodiment, the handheld device 10 is a mobile phone. However, the present invention is not limited thereto.

The appearance 20 is described as a sound hole cover of a speaker. However, the present invention is not limited thereto. The appearance 20 has a plurality of vias 50. In the present embodiment, there are sixteen vias 50, and in other embodiments, there may also be one or other numbers of vias 50. Further, those vias can be arranged randomly, and the present embodiment is not limited to the rectangular pattern. In the present embodiment, the vias 50 are conductive vias, and which can not only be used for electrically connecting the planar antenna 40 and a metal layer 60 but also be served as sound holes.

The system ground plane 30 is disposed inside the appearance 20. In the present embodiment, the planar antenna 40 is a monopole antenna such that a feed point 80 is disposed on the system ground plane 30. The feed point 80 is electrically connected to the metal layer 60 through a conductive element 70, wherein the conductive element 70 may be a spring. Accordingly, the planar antenna 40 is electrically connected to the feed point 80 of the system ground plane 30 through the vias 50, the metal layer 60, and the conductive element 70. In addition, by disposing the conductive device 70, the electrical connection between the planar antenna 40 and the system ground plane 30 is not damaged when the appearance 20 is disassembled, and the electrical connection between the planar antenna 40 and the system ground plane 30 is re-established through the conductive element 70 when the appearance 20 is assembled back to the handheld device 10. On the other hand, the planar antenna 40 can be a PIFA equipped with a feed point 80 on the system ground plan and also a ground point (not shown) for grounding function.

It should be mentioned that in the present embodiment, the planar antenna 40 is integrated with the appearance 20. For example, the planar antenna 40 is disposed on the appearance 20 through a coating technique, wherein the coating technique may be a molded interconnect device (MID) technique or a laser direct structuring (LDS) technique. Accordingly, the planar antenna 40 itself does not occupy any space in the handheld device 10. In other words, the handheld device 10 can have more internal space for accommodating other elements. For example, a speaker (not shown) may be disposed below the vias 50. In order to have better performance, the planar antenna can be replaced with a PIFA. In different embodiments, other elements may also be disposed by those skilled in the art according to the actual requirements.

In addition, the performance of the planar antenna 40 can be improved by integrating the planar antenna 40 with the appearance 20. It should be understood by those skilled in the art that the higher the clearance of the planar antenna 40 is, the better performance the planar antenna 40 has. The planar antenna disposition technique provided by the present embodiment can increase the distance between the planar antenna 40 and the system ground plane 30 or other metal devices so that the performance of the planar antenna 40 can be effectively improved.

Even though a possible pattern of the disposition method of a planar antenna in a handheld device has been described in foregoing embodiment, it should be understood by those having ordinary knowledge in the art that because different manufacturer has different design regarding the handheld device and the disposition method of the planar antenna, the application of the subject application is not limited to aforementioned pattern. In other words, it is within the scope of the subject application as long as the planar antenna is integrated with an appearance and coupled to a system ground plane inside the appearance through vias of the appearance. Some other embodiments of the present invention will be further described below so that those having ordinary knowledge in the art can understand the present invention better and implement the present invention according to the present disclosure.

In the first embodiment, the planar antenna 40 is a monopole antenna. However, the subject application is not limited thereto, and in other embodiments, the planar antenna 40 may also be a PIFA or a planar antenna of another type. For example, the planar antenna 40 may also be coupled to a ground point (not shown) on the system ground plane 30 through another via 50 of the appearance 20. However, this example will not be described herein.

In the first embodiment, the metal layer 60 is only an example but not intended to limit the subject application. For example, the metal layer 60 may also be replaced by a solder pad in another embodiment.

In the first embodiment, the conductive element 70 is a spring. However, the subject application is not limited thereto. For example, the conductive element 70 may also be a pogo pin in another embodiment.

Figure 3:
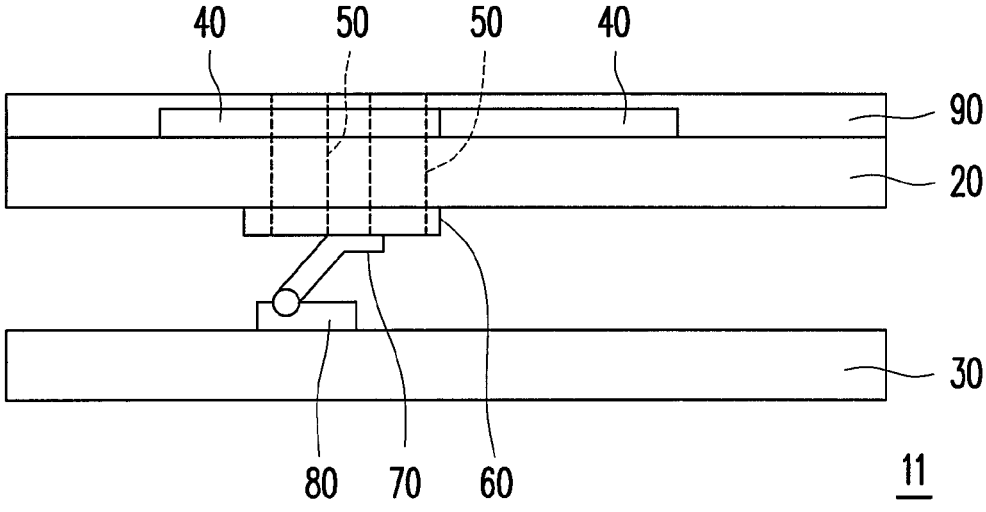
FIG. 3 is a side view of an appearance and a planar antenna according to a second embodiment of the present invention.

In the first embodiment, the planar antenna 40 is disposed on an external surface of the appearance 20. However, the subject application is not limited thereto. FIG. 3 is a side view of an appearance and a planar antenna according to a second embodiment of the present invention. The appearance and the planar antenna illustrated in FIG. 3 are similar to those illustrated in FIG. 2, and the difference between the two embodiments is that the handheld device 11 in FIG. 3 further includes a passivation layer 90. In the present embodiment, the passivation layer 90 covers the planar antenna 40 and the appearance 20. The passivation layer 90 may be paint, and which not only protects the planar antenna 40 from any damage but also prevents a user from touching the planar antenna 40 and accordingly affecting the performance of the planar antenna 40. Besides, the passivation layer 90 may be made of a transparent or a semi-transparent material so as to allow a user to see the shape of the planar antenna 40 and the handheld device 11 to have a modern look.

Figure 4:
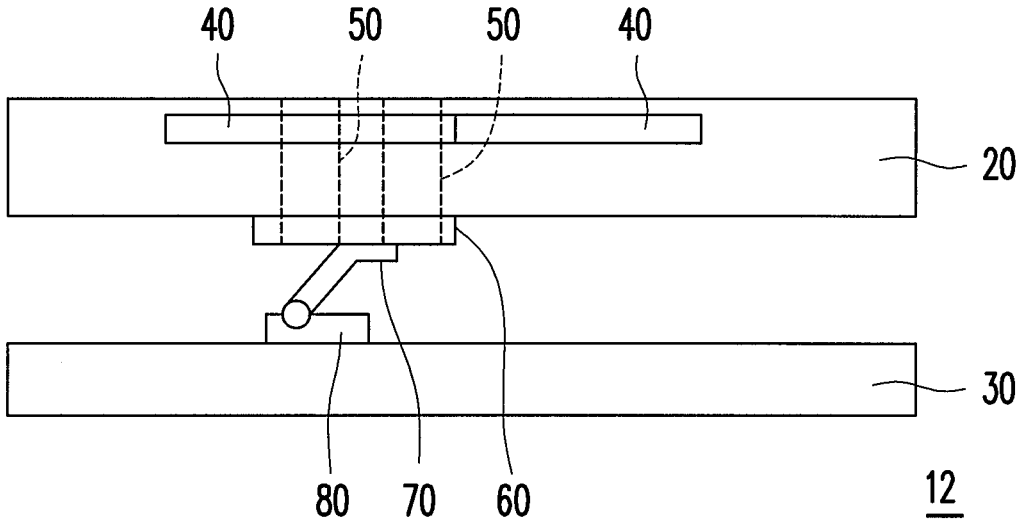
FIG. 4 is a side view of an appearance and a planar antenna according to a third embodiment of the present invention.

FIG. 4 is a side view of an appearance and a planar antenna according to a third embodiment of the present invention. The appearance and the planar antenna illustrated in FIG. 4 are similar to those illustrated in FIG. 2, and the difference between the two embodiments is that the planar antenna 40 of the handheld device 12 is buried in the appearance 20. In the present embodiment, the planar antenna 40 is disposed on an intermediate layer of the appearance 20 through an injection molding technique. The appearance 20 may be made of a transparent or a semi-transparent material so that a performance similar to that described in the second embodiment can be achieved.

Figure 5:
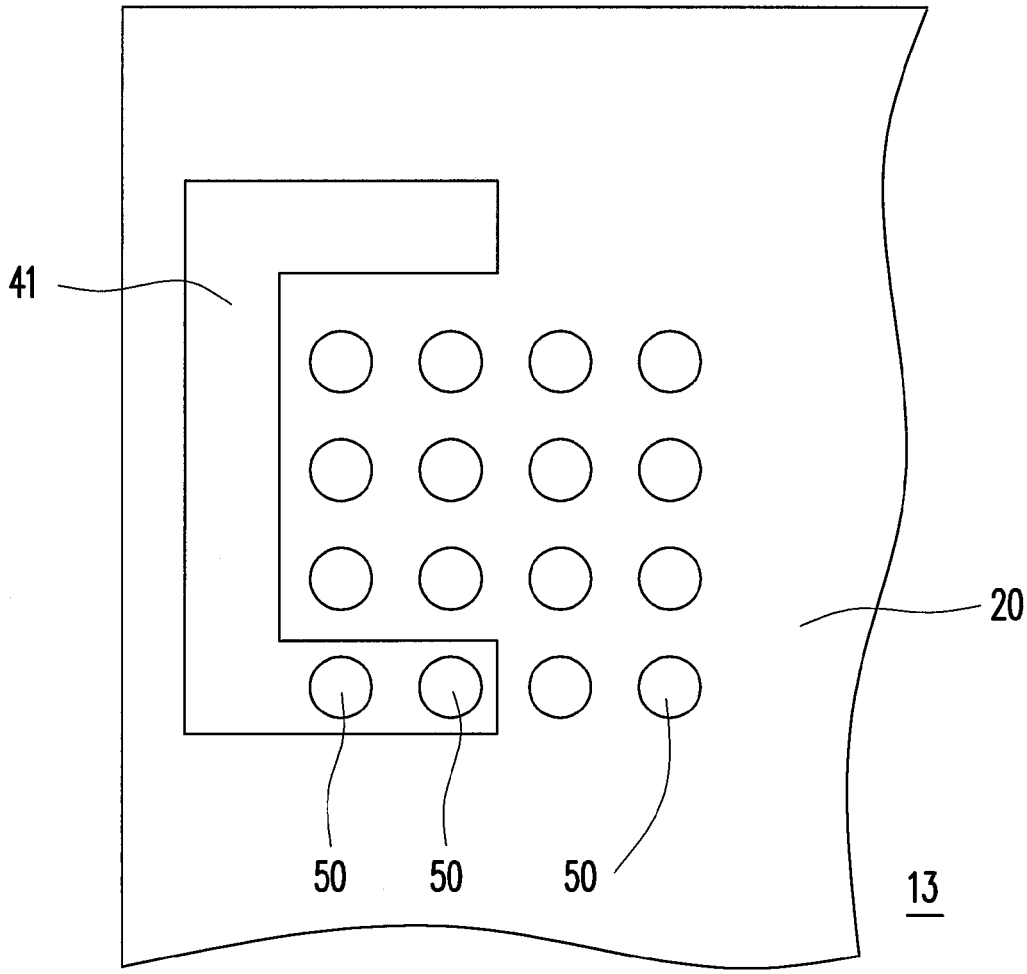
FIG. 5 is a top view of an appearance and a planar antenna according to a fourth embodiment of the present invention.

In addition, the shape of the planar antenna can be altered by those skilled in the art to allow the planar antenna to present a more meaningful or aesthetic pattern. FIG. 5 is a top view of an appearance and a planar antenna according to a fourth embodiment of the present invention. The handheld device 13 illustrated in FIG. 5 is similar to the handheld device 10 illustrated in FIG. 1, and the difference between the two embodiments falls on the shapes of the planar antenna 40 and the planar antenna 41. In the present embodiment, the planar antenna 41 is designed to have a C shape. However, the subject application is not limited thereto, and in other embodiments, the planar antenna may also be designed into other patterns by those skilled in the art according to the actual requirements.

Figure 6:
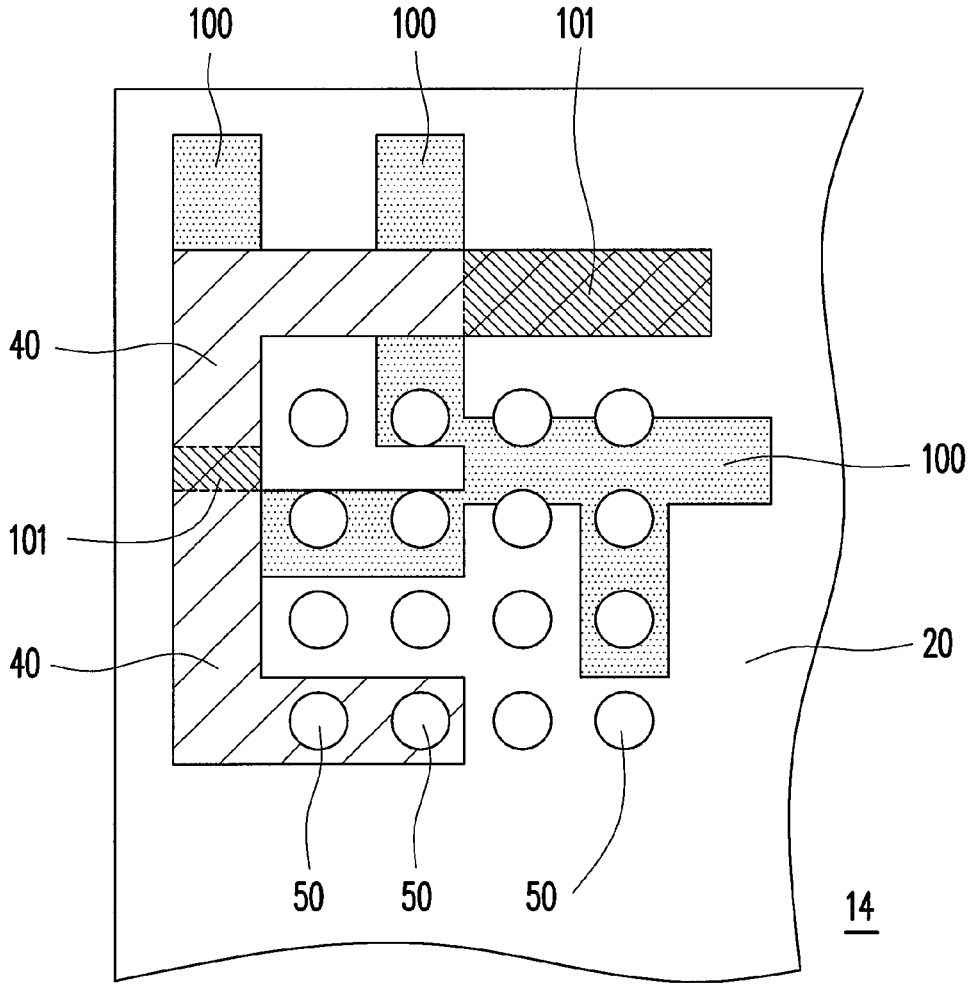
FIG. 6 is a top view of an appearance and a planar antenna according to a fifth embodiment of the present invention.

Moreover, the pattern of the planar antenna may also be decorated by those skilled in the art by using paint of different color. FIG. 6 is a top view of an appearance and a planar antenna according to a fifth embodiment of the present invention. In the handheld device 14 provided by the present embodiment, the pattern of the planar antenna 40 is decorated by using a coating material (for example, paint) of different color. To be specific, the pattern of the planar antenna 40 can be extended by using a coating material 100, wherein the color of the coating material 100 is similar to the color of the planar antenna 40. In addition, the pattern of the planar antenna 40 may also be covered by using a coating material 101, wherein the color of the coating material 101 is similar to the color of the appearance 20.

Figure 7:
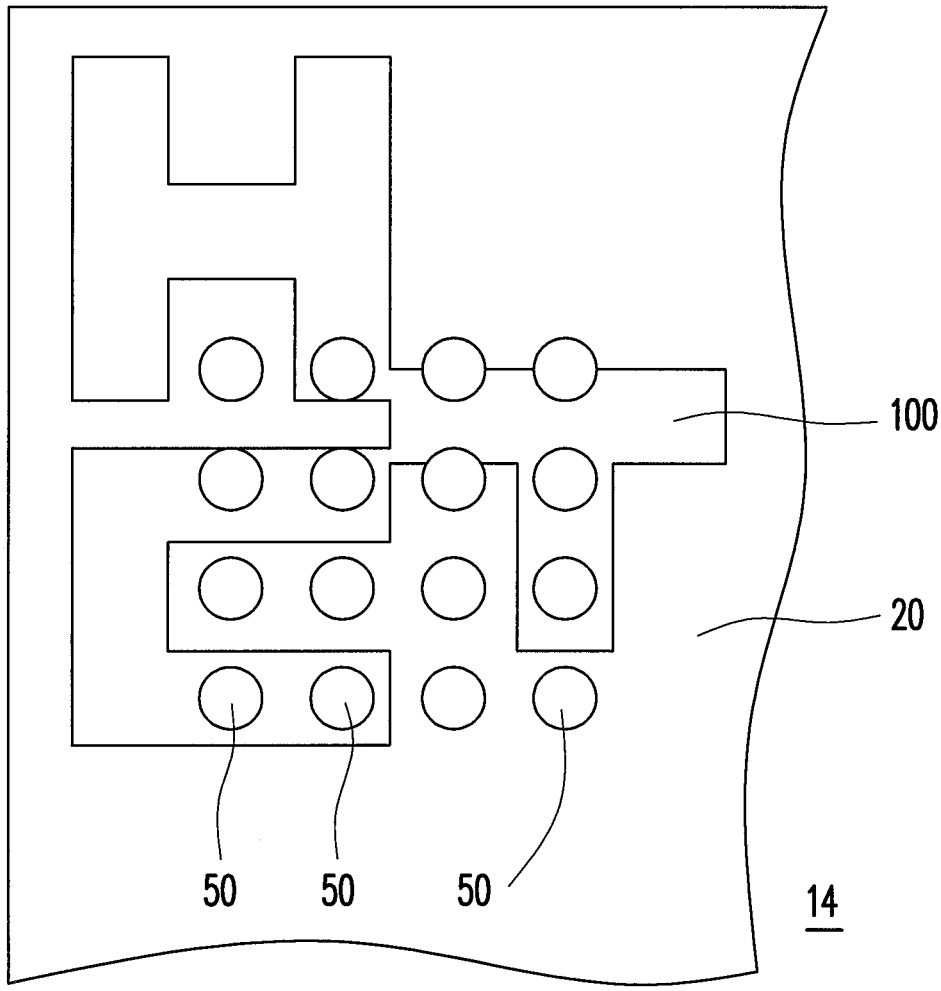
FIG. 7 is a top view of the appearance and the planar antenna in FIG. 6 after they are painted.

FIG. 7 is a top view of the appearance and the planar antenna in FIG. 6 after they are painted. After the planar antenna 40 is decorated by using the coating materials 100 and 101, the planar antenna 40 and the coating materials 100 and 101 present a pattern, HTC logo, as shown in FIG. 7. However, different patterns may also be achieved through the same technique by those skilled in the art but will not be described herein.

As described above, in the subject application, a planar antenna is integrated with an appearance and coupled to a system ground plane inside the appearance through vias of the appearance. Thereby, the performance of the planar antenna is improved. In addition, embodiments of the present invention further have following advantages:

1. a conductive element is disposed such that the electrical connection between the system ground plane and the planar antenna will not be damaged when the appearance is disassembled.

2. the vias of the appearance are also served as sound holes of a speaker so that the fabrication process can be simplified and the fabrication cost can be reduced.

3. the planar antenna is integrated with the appearance so that the planar antenna itself does not occupy any space in the handheld device.

4. a passivation layer is disposed on the planar antenna or the planar antenna is buried in the appearance, so that the planar antenna is protected from interference or damage caused by hand touching.

5. The passivation layer or the appearance covering the planar antenna can be made of a transparent or a semi-transparent material so that the shape of the planar antenna can be seen from outside the handheld device.

6. the pattern of the planar antenna can be decorated by using a coating material so that the planar antenna can present a modern or aesthetic pattern.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A handheld device, comprising:

a housing, comprising a via, wherein the housing is not a printed circuit board, and the via is served as a sound hole of a speaker;

a system ground plane, disposed inside the housing; and a planar antenna, disposed on the housing, and extended to an inner surface of the housing through the via so as to be coupled to the system ground plane.

2. The handheld device according to claim 1 further comprising:

a conductive device, coupled between the planar antenna and the system ground plane.

3. The handheld device according to claim 2, wherein the conductive device is a spring or a pogo pin.

4. The handheld device according to claim 1, wherein the planar antenna is disposed on the housing through a coating technique.

5. The handheld device according to claim 1, wherein the system ground plane comprising:

a feed point, coupled to the planar antenna.

6. The handheld device according to claim 5, wherein the system ground plane further comprises:

a ground point, coupled to the planar antenna.

7. The handheld device according to claim 1 further comprising:

a passivation layer, disposed on the housing, and covering the planar antenna.

8. The handheld device according to claim 1, wherein the planar antenna is disposed on an external surface of the housing.

9. The handheld device according to claim 1, wherein the planar antenna is disposed on an intennediate layer of the housing.

10. The handheld device according to claim 1, wherein the planar antenna forms a pattern on the housing.

11. The handheld device according to claim 1 further comprising:

a coating material, coated on the housing, wherein the coating material and the planar antenna form a pattern on the housing.

12. The handheld device according to claim 1 further comprising:

a first coating material, coated on the housing; and a second coating material, coated on the housing, wherein the first coating material, the second coating material, and the planar antenna form a pattern on the housing, and a color of the first coating material is different from a color of the second coating material.

13. A handheld device, comprising:

a housing, comprising a conductive via, wherein the housing is not a printed circuit board and the via is served as a sound hole of a speaker;

a system ground plane, disposed inside the housing; and a planar antenna, disposed on the housing, and coupled to the system ground plane through the conductive via.

14. A disposition method of a planar antenna, comprising:

forming a via in a housing, wherein the housing is not a printed circuit board and the via is served as a sound hole of a speaker; and disposing the planar antenna on the housing, wherein the planar antenna is extended to an inner surface of the housing through the via so as to be electrically connected to a system ground plane.

15. A disposition method of a planar antenna, comprising:

disposing the planar antenna on a housing, wherein the planar antenna is electrically connected to a via of the housing and coupled to a system ground plane inside the housing through the via and the housing is not a printed circuit board, and the via is served as a sound hole of a speaker.

* * * * *